US006341987B1

(12) United States Patent
Chih et al.

(10) Patent No.: US 6,341,987 B1
(45) Date of Patent: Jan. 29, 2002

(54) CABLE CONNECTOR ASSEMBLY

(75) Inventors: Kuo-Hua Chih, Tu-Chen; Jen Jou Chang, Yung-Ho, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/876,774

(22) Filed: Jun. 6, 2001

(30) Foreign Application Priority Data

Oct. 20, 2000 (TW) ..... 89218231

(51) Int. Cl.[7] ..... H01R 24/00

(52) U.S. Cl. ..... 439/626; 439/492; 439/67; 439/499; 439/456

(58) Field of Search ..... 439/676, 490, 439/344, 67, 77, 492, 499, 495, 456

(56) References Cited

U.S. PATENT DOCUMENTS 4,566,749 A * 1/1986 Johnston ..... 439/676
4,934,947 A * 6/1990 Brummans et al. ..... 439/492
5,556,307 A * 9/1996 Johnston ..... 439/676
5,954,537 A * 9/1999 Sonobe et al. ..... 439/67

* cited by examiner

*Primary Examiner*—Tho D. Ta
(74) *Attorney, Agent, or Firm*—Wei Te Chung

(57) ABSTRACT

A cable connector assembly (1) includes a connector (10) including an insulating housing (11) and a plurality of terminals (13), a cable assembly (20) including a plurality of wires each having an exposed conductor (21), and a connection mechanism (30) including a base (31) positioning the wires with a first portion (311) and a second portion (312) and a clip (32). The terminals (13) each define an engaging portion (132) and a mating portion (131) and are received in passageways (110) defined in the insulating housing (11) of the connector (10). The first portion (311) has a plurality of spacers (3111) and protrusions (3112) thereon to pre-position the wires of the cable assembly (20). The second portion (312) has a plurality of slots (3121) for receiving the engaging portions (132) to engage with the exposed conductors (21) therein. The clip (32) has a plurality of protruding ends (321) to clamp the cable assembly on the base (31) firmly.

10 Claims, 5 Drawing Sheets

CABLE CONNECTOR ASSEMBLY

BACKGROUND OF THE INVENTION

1. Field of the Invention

The present invention is related to a cable connector assembly, and particularly to a cable connector assembly having an RJ-11 modular jack and an RJ-45 modular jack integrated together side-by-side and a cable connecting with terminals of the jacks.

2. Description of the Related Prior Art

A cable connector assembly includes a connector for mating with a complementary connector and a cable for connecting with an electrical device. U.S. Pat. No. 5,624,274 disclosed a cable connector assembly comprising a modular jack, a cable and a connection mechanism. The modular jack has a plurality of insulating displacement connection (IDC) terminals. Each terminal of the modular jack pierces an insulation jacket surrounding a center conductor of each wire of the cable to electrically contact the center conductor. To achieve the IDC connection, the terminals and the housing of the modular jack need a complicated structure.

Hence, an improved cable connector assembly is required to overcome the disadvantages of the prior art.

BRIEF SUMMARY OF THE INVENTION

A first object of the present invention is to provide a cable connector assembly which has a simple configuration.

A second object of the present invention is to provide a cable connector assembly which requires less assembly space.

To achieve the above-mentioned objects, a cable connector assembly in accordance with the present invention comprises a modular jack, a cable assembly and a connection mechanism. The modular jack includes an insulating housing having at least one receiving space and a plurality of terminals received in the at least one receiving space. The connection mechanism defines a clip and a base, the base comprising a first portion and a second portion. The cable assembly includes a plurality of wires positioned on the first portion and exposed front ends of wire conductors are positioned on the second portion. The clip clamps the wire on the first portion firmly. The terminals are received in the second portion and connected electrically with the exposed conductors, respectively.

Other objects, advantages and novel features of the invention will become more apparent from the following detailed description of the present embodiment when taken in conjunction with the accompanying drawings.

DETAILED DESCRIPTION OF THE INVENTION

Figure 1:
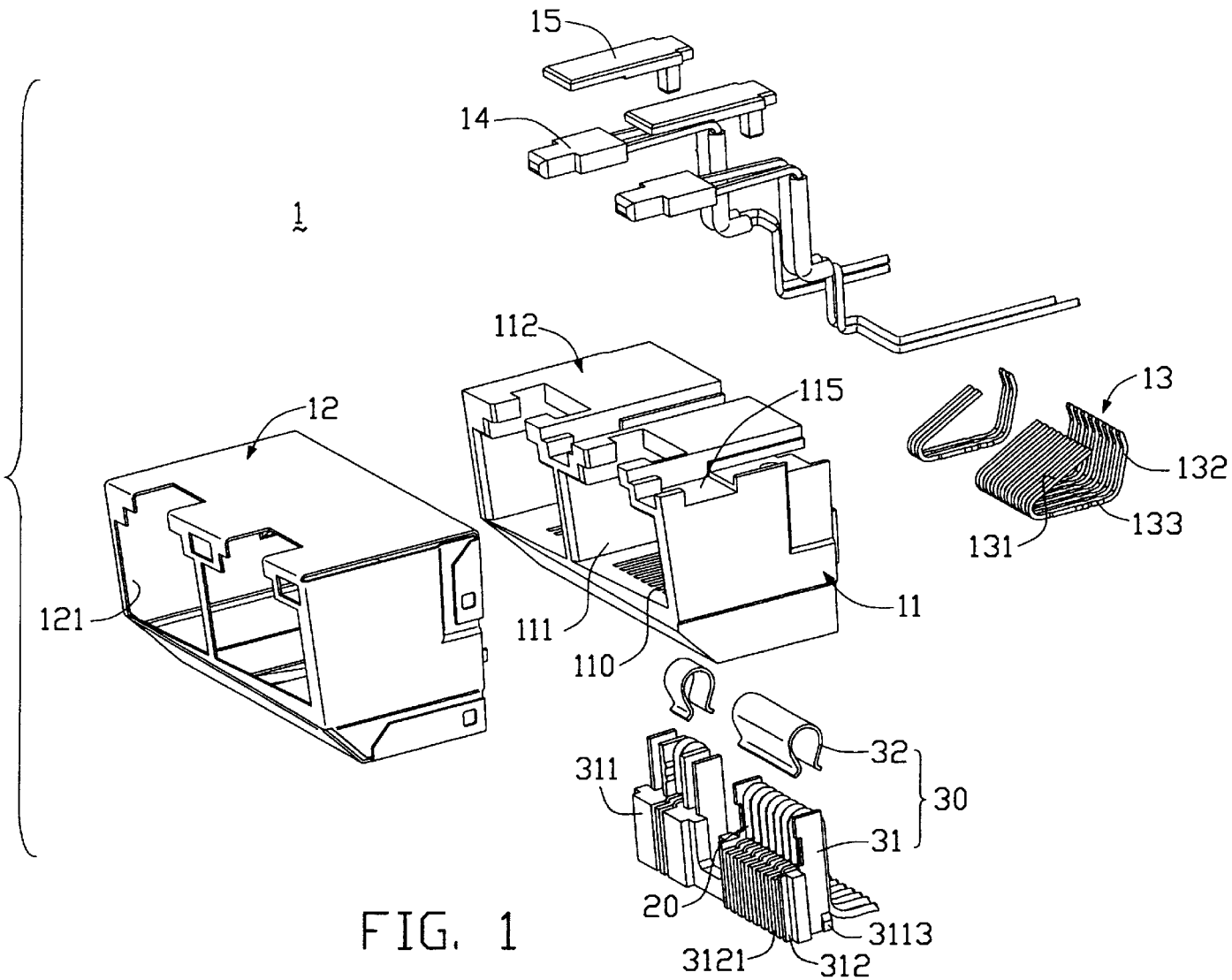
FIG. 1 is an exploded view of a cable connector assembly in accordance with the present invention.

Referring to FIG. 1, a cable connector assembly 1 in accordance with the present invention comprises a modular jack connector 10, a cable assembly 20 and a connection mechanism 30. The modular jack connector 10 comprises an insulating housing 11, a metal shield 12, a plurality of terminals 13, two light emitting diode (LED) devices 14 and two auxiliary elements 15.

The housing 11 is rectangular in shape and defines two receiving spaces 111 arranged side by side for receiving complementary plugs (not shown). A number of passageways 110 are defined in a bottom plate of the housing 11 to communicate with the receiving spaces 111. A top plate 112 of the housing 2 defines two recesses 115 for receiving the LEDS 14 and the cover elements 15.

Each terminal 13 forms a mating portion 131 and an engaging portion 132 extending substantially upwardly from a rear end of the terminal 13. A number of bards 133 are formed on two side of the terminal 13 to interference fit with inner surfaces of the passageways 110.

Figure 2:
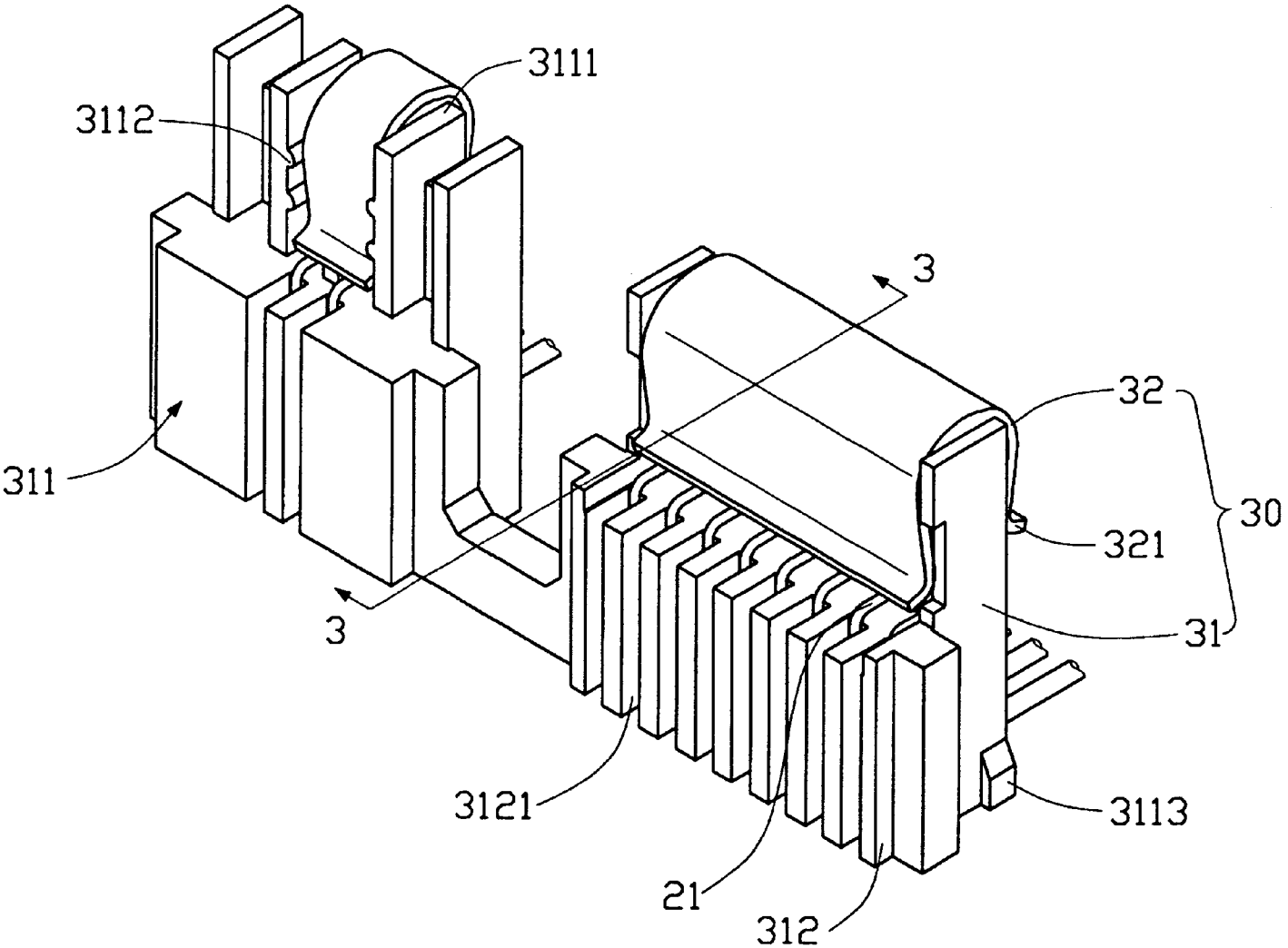
FIG. 2 is a perspective view of a connection mechanism of the cable connector assembly in accordance with the present invention.
Figure 3:
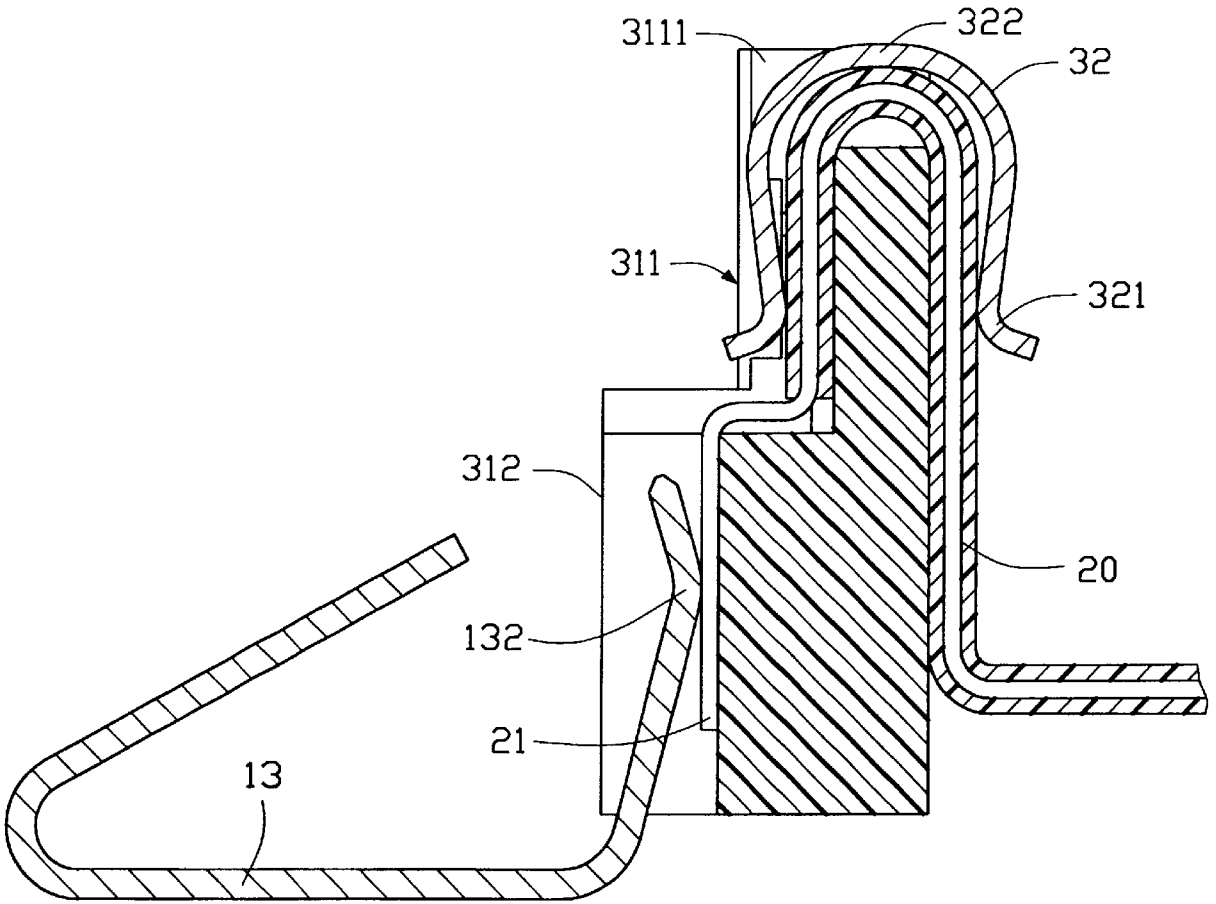
FIG. 3 is a cross-section view taken along line 3—3 in FIG. 2.

Referring to FIGS. 2 and 3, the connection mechanism 30 defines a base 31 and two clips 32, wherein the base comprises a first portion 311 and a second portion 312 with a bridge (not labeled) therebetween. The first portion 311 defines a number of spacers 3111 with a plurality of protrusions 3112 thereon to pre-position the wires of the cable assembly 20. The second portion 312 defines a plurality of slots 3121 to receive the engaging portions 132 and the exposed conductor 21 of the wires of the cable assembly 20. The width of the slot 3121 is approximately equal to a diameter of the exposed conductors 21 of the wires to fix them firmly in the slots 3121. The clips 32 have a top piece 322 pressing on the wires in the base 31 and a pair of protruding ends 321 clamping the cable assembly 20 on the base 31. The first portion 311 defines a pair of protrusions 3113 on side surfaces thereof to connect the base 31 and the housing 11.

Figure 5:
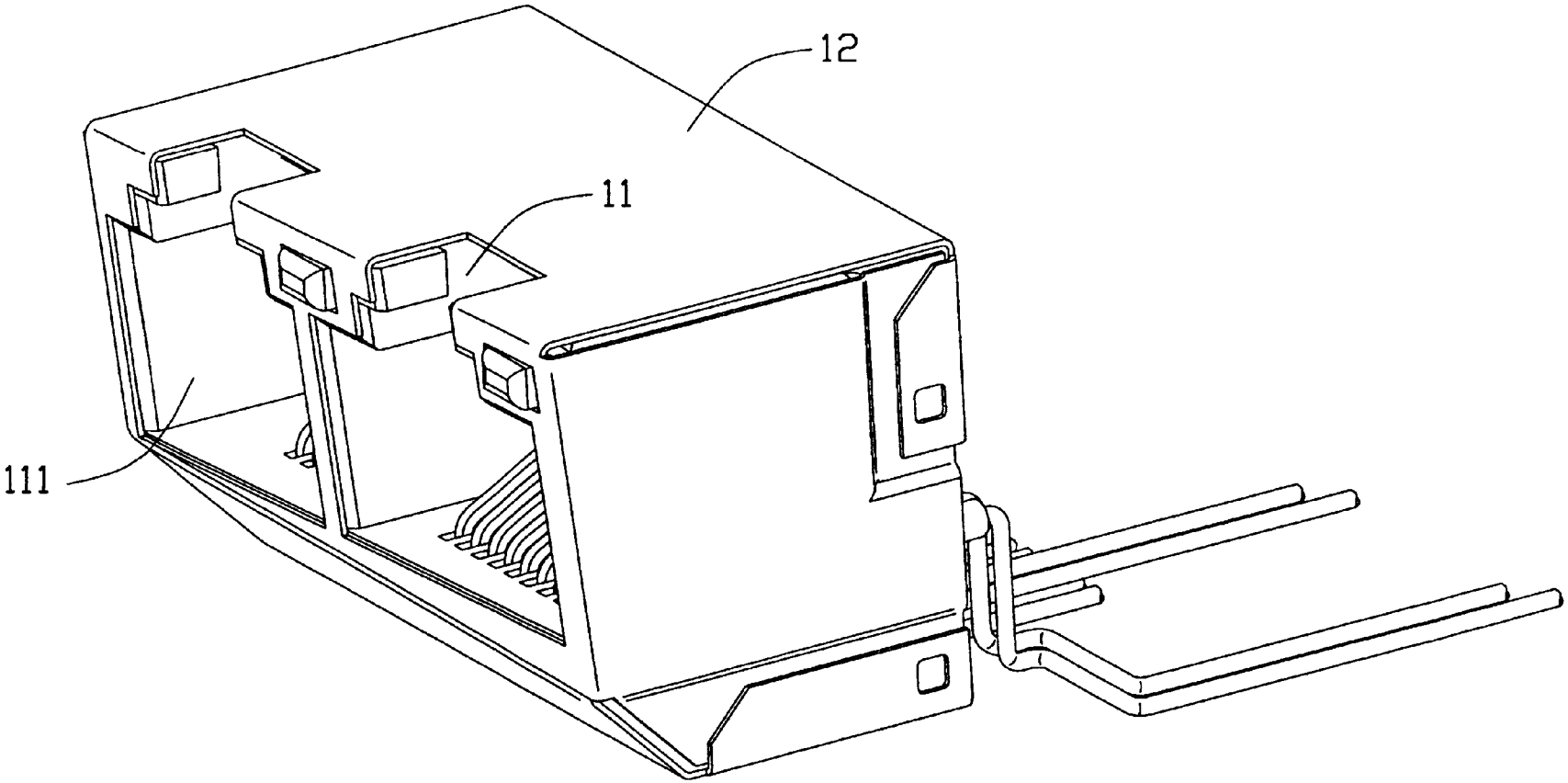
FIG. 5 is an assembled view of a modular jack connector assembly of FIG. 1.

Referring to FIGS. 1 and 5, the metal shield 12 defines two openings 121 corresponding to the receiving space 111.

Figure 4:
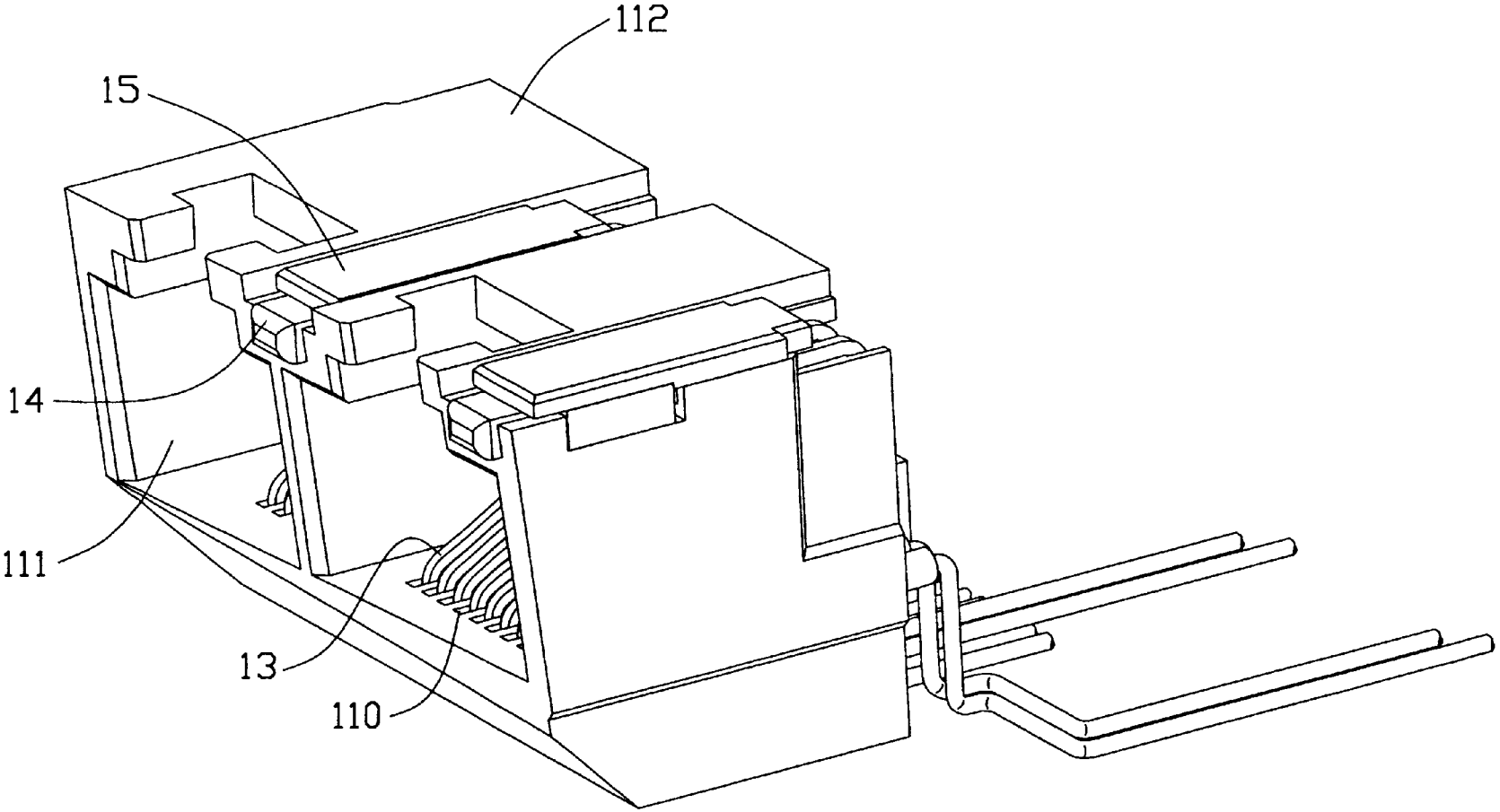
FIG. 4 is a partly assembled rear view of the cable connector assembly with a shield.

Referring to FIGS. 1 and 4, in assembly, the cable assembly 20 is positioned on the base 31, and the clips 32 is assembled to clamp the cable assembly 20 firstly and then the terminals 13 is received in the passageways 110 of the housing 11. Inserting the incorporate connection mechanism 30 into the receiving space 111 from the underside of the housing 11, the exposed conductors 21 will engage with the engaging portions 132 of the terminals 13. The LEDS 14 are fixed in the receiving accesses 115. Then, the cover elements 15 are assembled on the LEDS 14 to keep the LEDS 14 in the receiving accesses 115. Referring to FIG. 5, the metal shield 12 covers the housing 11. Thus, the cable connector assembly 1 is assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising: a connector defining an insulating housing and a plurality of terminals, wherein each terminal defines an engaging portion and a slanted mating portion received in one of a plurality of passageways defined in said insulating housing;

a cable assembly comprising a plurality of wires each having an exposed conductor; and a connection mechanism comprising a base and a clip, said clip comprises a top piece and two protruding ends, said protruding ends clamping said wires of the cable assembly on said base before the connection mechanism is assembled to the housing to present said exposed conductors to be contacted by said engaging portion of said terminal.

2. The cable connector assembly as claimed in claim 1, wherein said connector further includes a light emitting diode and a cover element and said housing defines a top wall having a recess to receive said light emitting diode and the cover element.

3. The cable connector assembly as claimed in claim 1, wherein said base has a plurality of slots receiving said engaging portions and said exposed conductors.

4. The cable connector assembly as claimed in claim 3, wherein a width of said slot is approximately equal to a diameter of said exposed conductor of said wire.

5. The cable connector assembly as claimed in claim 3, wherein said base comprises a first portion and a second portion.

6. The cable connector assembly as claimed in claim 5, wherein said first portion of said base defines a pair of spacers.

7. The cable connector assembly as claimed in claim 6, wherein each spacer has a plurality of protrusions at an inner surface thereof.

8. A cable connector assembly comprising:

a connector defining an insulative housing with two separate receiving spaces each with a plurality of terminals therein, each of said terminals including an engagement portion and a slanted mating portion;

a cable assembly comprising a plurality of wires each having an exposed conductor; and a connection mechanism including an unitary base retained within the housing, said base including first and second portions, respectively received within the corresponding spaces, with the wires fixedly mounted thereon; wherein the exposed conductors of the wires mechanically engage the engagement portions of the corresponding terminals, respectively, for establishment of electrical connection therebetween;

wherein the wires are fixed to the first and second portions of the base by means of two respective clips before the connection mechanism is assembled to the housing, each clip comprises a top piece and two protruding ends for clamping said cable assembly to the base.

9. The assembly as claimed in claim 8, wherein a bridge is integrally connected between the first portion and the second portion.

10. A method for making a cable connector assembly, comprising the steps of:

providing an insulative housing;

disposing a plurality of terminals in the housing, each of said terminals including an engagement portion and a slanted mating portion;

providing a cable with a plurality of wires thereof;

providing a base;

fastening said plurality of wires onto the base by a clip having a top piece and two protruding ends with inner conductors of the wires exposed to an exterior of the clip;

assembling the base, with the protruding ends of the clip clamping the wires thereon, into the housing with the exposed conductors engaging the corresponding engagement portions, respectively.

* * * * *